US008805214B2

(12) United States Patent
Fujita et al.

(10) Patent No.: US 8,805,214 B2
(45) Date of Patent: Aug. 12, 2014

(54) IMAGE FORMING APPARATUS

(75) Inventors: Masanari Fujita, Osaka (JP); Kenji Nakamura, Osaka (JP); Tomohiro Kubota, Osaka (JP); Yoshiyuki Shimizu, Osaka (JP); Masato Tsuji, Osaka (JP); Shoh Tsuritani, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 222 days.

(21) Appl. No.: 13/405,675

(22) Filed: Feb. 27, 2012

(65) Prior Publication Data

US 2012/0230708 A1 Sep. 13, 2012

(30) Foreign Application Priority Data

Mar. 11, 2011 (JP) ..... 2011-054197

(51) Int. Cl.
*G03G 15/08* (2006.01)

(52) U.S. Cl.
USPC ..... 399/27; 399/111

(58) Field of Classification Search
CPC combination set(s) only.
See application file for complete search history.

(56) References Cited

U.S. PATENT DOCUMENTS

| | | | | |
|---|---|---|---|---|
| 7,890,044 | B2 | 2/2011 | Shimizu et al. | |
| 2007/0092286 | A1* | 4/2007 | Suzuki et al. | 399/90 |
| 2009/0060562 | A1* | 3/2009 | Itabashi | 399/98 |

FOREIGN PATENT DOCUMENTS

| | | | |
|---|---|---|---|
| CN | 101025594 | A | 8/2007 |
| JP | 2004-301896 | | 10/2004 |
| JP | 2005-121952 | | 5/2005 |
| JP | 2005-201922 | | 7/2005 |
| JP | 2005-345914 | | 12/2005 |
| JP | 2007-93931 | | 4/2007 |
| JP | 2007-147764 | | 6/2007 |
| JP | 2007-219269 | | 8/2007 |
| JP | 2010-66769 | | 3/2010 |
| JP | 2010-107775 | | 5/2010 |

OTHER PUBLICATIONS

U.S. Appl. No. 13/344,940, filed Jan. 6, 2012, Tomofumi Yoshida, et al.
U.S. Appl. No. 13/352,732, filed Jan. 18, 2012, Tomohiro Kubota, et al.
Combined Office Action and Search Report issued Sep. 6, 2013 in Chinese Patent Application No. 201210040617.7 (with English translation of category of cited documents).

* cited by examiner

*Primary Examiner* — Clayton E Laballe
*Assistant Examiner* — Jas Sanghera
(74) *Attorney, Agent, or Firm* — Oblon, Spivak, McClelland, Maier & Neustadt, L.L.P.

(57) ABSTRACT

An image forming apparatus includes an image bearer, an optical writing unit to writing an electrostatic latent image on the image bearer, the optical writing unit including multiple optical writing elements arranged in a longitudinal direction of the image bearer and a frame to hold the multiple optical writing elements, a development device to develop the electrostatic latent image on the image bearer with developer, a developer container for containing the developer supplied to the development device, and a developer amount detector to detect an amount of developer contained in the developer container based on a light transmission amount between a light-emitting element and a light-receiving element. At least one of the light-emitting element and the light-receiving element of the developer amount detector is attached to the optical writing unit.

17 Claims, 9 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2011-054197, filed on Mar. 11, 2011, in the Japan Patent Office, the entire disclosure of which is hereby incorporated by reference herein.

FIELD OF THE INVENTION

The present invention generally relates to an image forming apparatus, such as a copier, a printer, a plotter, or a multifunction machine including at least two of these functions.

BACKGROUND OF THE INVENTION

There are electrophotographic image forming apparatuses in which the amount of developer contained in a development device decreases as it is consumed in image development, and fresh developer is supplied from a developer container to the development device when the amount of developer therein falls to or below a predetermined amount. Thus, the amount of developer therein is kept in a given range. Additionally, the developer container and the development device may be housed in a common unit casing, forming a single development unit removably installed in the image forming apparatus. When the amount of developer contained in the development unit falls to or below the predetermined amount, the development unit is replaced as a whole.

Such configurations require a detector to detect the amount of developer inside the development device or development unit. Therefore, various types of detectors have been proposed to detect the amount of developer. For example, light transmission-type detectors including optical elements are used to detect the amount of developer.

Light transmission-type developer amount detectors determine the amount of developer in the developer container based on the amount of light transmission therein.

In this method, light emitted from a light-emitting element can be guided to a light-receiving element using first and second light guides provided inside the developer container across a clearance. The first and second light guide are constructed of, for example, prisms or mirrors. When the amount of developer in the developer container is sufficient, a light path formed between the first and second light guides is blocked by the developer, and the light-receiving element does not receive the light. However, when the amount of developer in the developer container is reduced to or below a reference amount, the developer does not block the light path, and the light can reach the light-receiving element. It can be determined whether the amount of developer has decreased below the reference amount by measuring the output from the light-receiving element (as disclosed in JP-2007-219269-A, JP-4358038-B, and JP-4398421-B).

The development unit, an image bearer such as a photoreceptor, and the like may be housed in a common unit casing, forming a modular unit (i.e., a process unit), which is typically longer in the axial direction of the photoreceptor. In such process units, the amount of developer tends to be uneven in an end portion in its longitudinal direction. Accordingly, it is preferred to detect the amount of developer in a center portion in the longitudinal direction, in which the amount of developer is relatively uniform.

Depending on the layout of the development unit, the photoreceptor, and the like, however, it is difficult to dispose the light-emitting element and the light-receiving element in the center portion in the longitudinal direction. For example, in an arrangement in which the development unit is above the photoreceptor, it is difficult to provide a separate positioning member around the development unit for fixing the light-emitting element and the light-receiving element in position. Therefore, the light-emitting element and the light-receiving element are disposed on a side wall of the image forming apparatus adjacent to an end of the development unit in the longitudinal direction.

Although the amount of developer in the center portion of the development unit can be detected using a light guide extending from the end portion to the center portion of the development unit to guide the light from the light-emitting element, it is possible that the light is attenuated while passing through the long light guide. Accordingly, light-emitting elements of higher output power are required, thus increasing the cost.

BRIEF SUMMARY OF THE INVENTION

In view of the foregoing, in one embodiment of the present invention, an image forming apparatus includes an image bearer, an optical writing unit to writing an electrostatic latent image on the image bearer, a development device to develop the electrostatic latent image on the image bearer with developer, a developer container for containing the developer supplied to the development device, and a developer amount detector including a light-emitting element and a light-receiving element. The optical writing unit includes multiple optical writing elements arranged in a longitudinal direction of the image bearer and a frame to hold the multiple optical writing elements. The developer amount detector detects an amount of developer contained in the developer container based on a light transmission amount between the light-emitting element and the light-receiving element, and at least one of the light-emitting element and the light-receiving element of the developer amount detector is attached to the optical writing unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
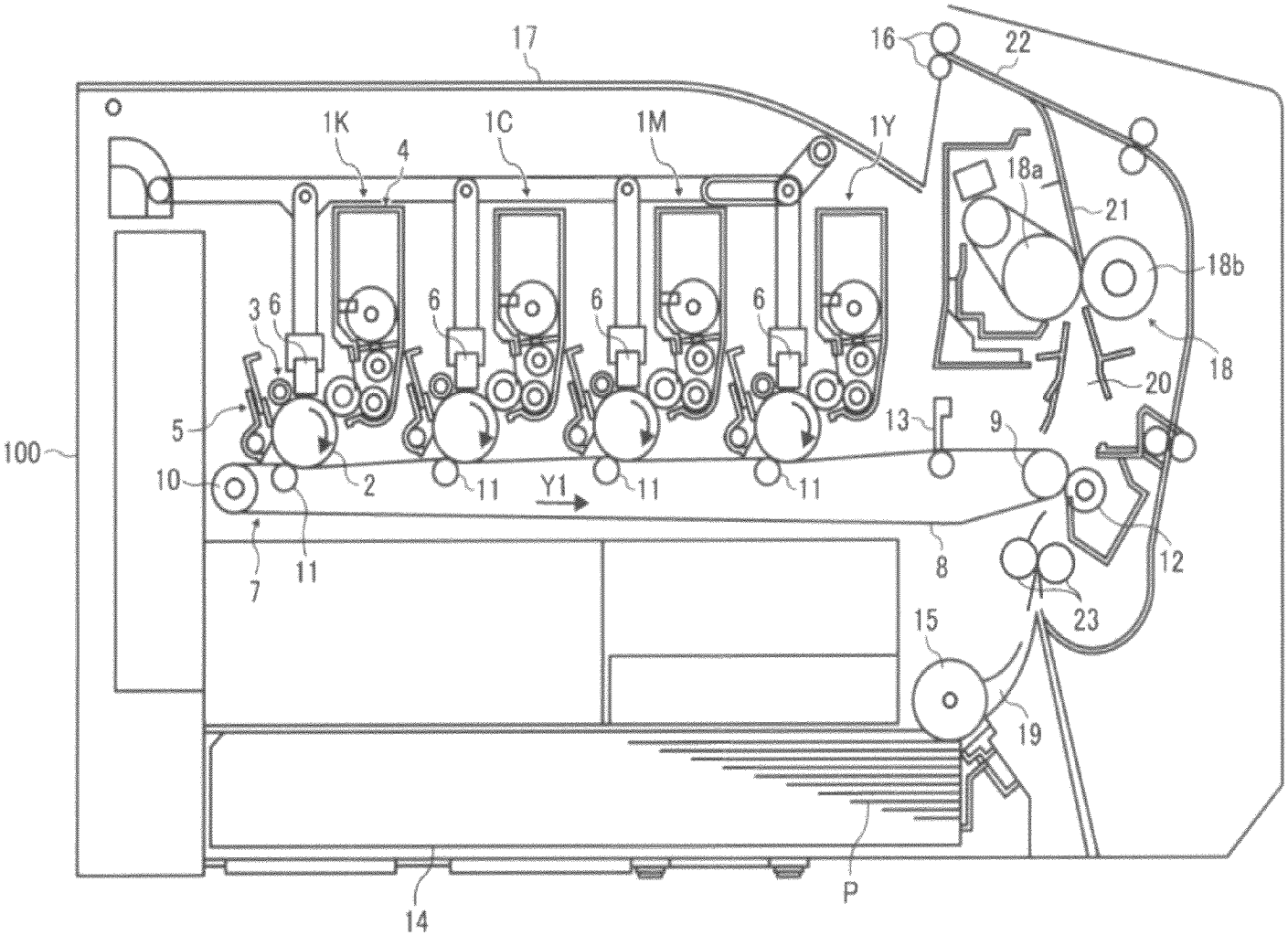
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Referring to FIG. 1, a configuration and operation of an image forming apparatus according to an embodiment is described below.

An image forming apparatus 100 shown in FIG. 1 can be, for example, a multicolor laser printer and includes four process units 1Y, 1M, 1C, and 1K removably installable in an apparatus body thereof. The process units 1Y, 1M, 1C, and 1K respectively contain yellow (Y), magenta (M), cyan (C), and black (K) developer corresponding to decomposed color components of full-color images and have a similar configuration except the color of developer contained therein. It is to be noted that two-component developer consisting essentially of carrier (carrier particles) and toner (toner particles) is used in the present embodiment.

More specifically, each process unit 1 includes a drum-shaped photoreceptor 2 serving as a latent image bearer, a charger 3 to charge the surface of the photoreceptor 2, a development device 4 to supply toner to the surface of the photoreceptor 2, and a cleaning unit 5 to clean the surface of the photoreceptor 2. It is to be noted that, in FIG. 1, the photoreceptor 2, the charger 3, the development device 4, and the cleaning unit 5 of only the process unit 1K for black are given reference numerals, and reference numerals of those of the other process units 1Y, 1M, and 1C are omitted.

An optical writing head 6 (optical writing unit) to optically write electrostatic latent images on the photoreceptor 2 is provided above the photoreceptor 2 in each process unit 1 in FIG. 1. The optical writing head 6 includes multiple optical writing elements arranged in the longitudinal direction of the photoreceptor 2 and multiple rod lenses arranged in accordance with the respective optical writing elements. Thus, the optical writing head 6 extends in the longitudinal direction of the photoreceptor 2. The rod lenses are arranged between the optical writing elements and the surface of the photoreceptor 2 so that the light emitted from the optical writing elements are directed through the rod lenses to the surface of the photoreceptor 2. Although the optical writing elements in the present embodiment are light-emitting diodes (LEDs), alternatively, organic electroluminescent (EL) elements may be used instead.

Additionally, the optical writing head 6 is disposed at a predetermined or given position accurately using spacers provided to a housing of the photoreceptor 2 and those provided between the photoreceptor 2 and the optical writing head 6 to keep the focal distance of the optical writing head 6 relative to the photoreceptor 2 within a reference focal distance ±about 60 μm.

Additionally, a transfer device 7 is provided beneath the respective photoreceptors 2. The transfer device 7 includes an intermediate transfer belt 8 that can be, for example, an endless belt onto and from which an image is transferred. The intermediate transfer belt 8 is stretched around support rollers, namely, a driving roller 9 and a driven roller 10. As the driving roller 9 rotates counterclockwise in FIG. 1, the intermediate transfer belt 8 rotates in the direction indicated by arrow Y1 shown in FIG. 1. Additionally, a belt cleaning unit 13 to clean the surface of the intermediate transfer belt 8 is provided facing a right end portion of the intermediate transfer belt 8 from the outer circumferential side in FIG. 1.

The image forming apparatus 100 further includes four primary-transfer rollers 11 positioned facing the respective photoreceptors 2 via the intermediate transfer belt 8. Each primary-transfer roller 11 is pressed against an inner circumferential surface of the intermediate transfer belt 8, thus forming a primary-transfer nip between the intermediate transfer belt 8 and the corresponding photoreceptor 2. Each primary-transfer roller 11 is electrically connected to a power source and receives a predetermined amount of voltage including at least one of direct-current (DC) voltage and alternating current (AC) voltage. It is to be noted that, instead of the primary-transfer rollers 11, transfer chargers or transfer brushes may be used.

Additionally, a secondary-transfer roller 12 is provided at a position facing the driving roller 9 via the intermediate transfer belt 8. The secondary-transfer roller 12 is pressed against an outer circumferential surface of the intermediate transfer belt 8, and thus a secondary-transfer nip is formed between the secondary-transfer roller 12 and the intermediate transfer belt 8. Similarly to the primary-transfer rollers 11, the secondary-transfer roller 12 is electrically connected to a power source and receives a predetermined amount of voltage including at least one of DC voltage and AC voltage.

The image forming apparatus 100 further includes a sheet cassette 14 for containing sheets P of recording media such as paper or overhead projector (OHP) films, provided beneath the apparatus body, a pair of discharge rollers 16, and a discharge tray 17. The sheet cassette 14 is provided with a feed roller 15 to pick up and transport the sheets P from the sheet cassette 14. The pair of discharge rollers 16 is positioned in an upper portion of the apparatus body to discharge the sheets P outside the image forming apparatus 100, and the sheets P thus discharged are stacked on the discharge tray 17 formed on an upper surface of the apparatus body. A fixing device 18 is provided above the secondary-transfer nip in FIG. 1. The fixing device 18 includes a fixing roller 18*a* in which a heat source such as a halogen lamp is provided and a pressure roller 18*b* pressing against the fixing roller 18*a*, thus forming a fixing nip therebetween. The sheet P is clamped in the fixing nip.

A conveyance path is formed inside the apparatus body so that the sheet P is conveyed from the sheet cassette 14 to the secondary-transfer nip and further to the discharge tray 17. The conveyance path includes a post-feeding path 19 leading from the sheet cassette 14 to the secondary-transfer roller 12, a post-transfer path 20 leading from the secondary-transfer roller 12 to the fixing device 18, a post-fixing path 21 leading from the fixing device 18 to the discharge rollers 16, and a discharge path 22. A pair of registration rollers 23 is provided adjacent to a downstream end of the post-feeding path 19 in the direction in which the sheet P is conveyed (hereinafter "sheet conveyance direction").

The image forming apparatus 100 configured as described above operates as follows.

When image formation is started, the photoreceptors 2 in the respective process units 1 are rotated clockwise in FIG. 1, and the changers 3 uniformly charge the surfaces of the photoreceptors 2 to a predetermined polarity. Then, the optical writing heads 6 optically write electrostatic latent images on the charged surfaces of the respective photoreceptors 2 according to, for example, image data of originals read by a reading unit. More specifically, single color data, namely, yellow, cyan, magenta, and black color data decomposed from full-color image data are write as image data on the surfaces of the photoreceptors 2. The electrostatic latent images formed on the photoreceptors 2 are developed into toner images with toner supplied by the respective development devices 4.

Meanwhile, the driving roller 9 rotates, and accordingly the intermediate transfer belt 8 rotates in the direction indicated by arrow Y1 shown in FIG. 1. The predetermined voltage (i.e., transfer bias voltage), polarity of which is the opposite that of toner, is applied to the respective primary-transfer rollers 11, thus forming transfer electrical fields in the primary-transfer nips between the primary-transfer rollers 11 and the photoreceptors 2. The transfer bias voltage may be a constant voltage or voltage controlled in constant-current control method. The transfer electrical fields generated in the primary-transfer nips transfer the toner images from the respective photoreceptors 2 and superimpose them one on another on the intermediate transfer belt 8. Thus, a multicolor toner image is formed on the intermediate transfer belt 8. After primary transfer, the cleaning units 5 remove toner remaining on the respective photoreceptors 2

Additionally, when image formation is started, the feed roller 15 rotates, thereby transporting the sheet P from the sheet cassette 14 to the post-feeding path 19. Then, the registration rollers 23 forward the sheet P to the secondary-transfer nip formed between the secondary-transfer roller 12 and the intermediate transfer belt 8, timed to coincide with the multicolor toner image (superimposed single-color toner images) formed on the intermediate transfer belt 8. At that time, the transfer bias voltage whose polarity is opposite that of the toner image on the intermediate transfer belt 8 is applied to the secondary-transfer roller 12, and thus the transfer electrical field is formed in the secondary-transfer nip. The transfer electrical field generated in the secondary-transfer nip transfers the superimposed toner images from the intermediate transfer belt 8 onto the sheet P at a time. The belt cleaning unit 13 removes any toner remaining on the intermediate transfer belt 8 after image transfer.

Subsequently, the sheet P is transported through the post-transfer path 20 to the fixing device 18. In the fixing device 18, while the sheet P is transported by the fixing roller 18*a* and the pressure roller 18*b* pressing against each other via the sheet P, the toner thereon is fused and fixed with heat and pressure. After being discharged from the fixing device 18, the sheet P is transported through the post-fixing path 21 as well as the discharge path 22 and discharged by the discharge rollers 16 outside the apparatus to the discharge tray 17.

It is to be noted that, although the description above concerns multicolor image formation, alternatively, the image forming apparatus 100 can form single-color images, bicolor images, or three-color images using one, two, or three of the four process units 1.

Figure 2:
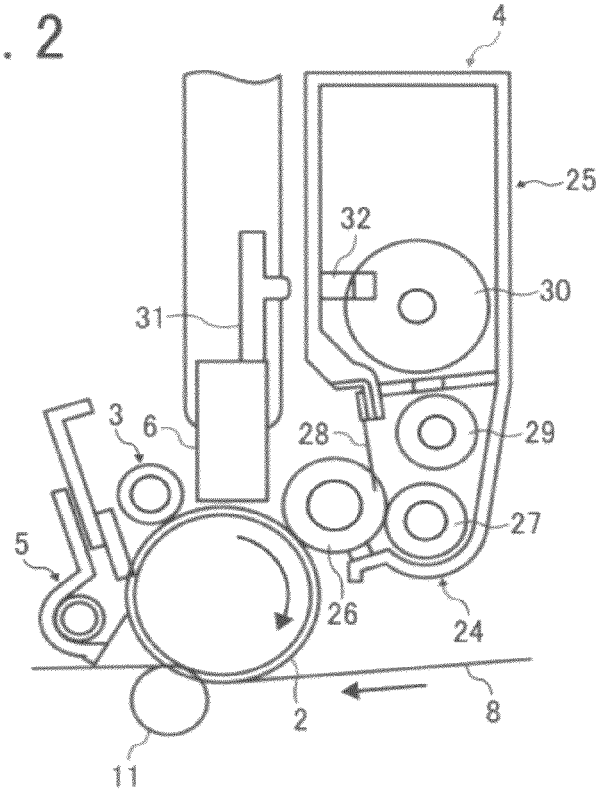
FIG. 2 is a schematic cross-sectional view illustrating a modular unit (process unit) installed in an apparatus body of the image forming apparatus.

FIG. 2 is a schematic end-on axial view of the process unit.

As shown in FIG. 2, the development unit 4 includes a development device 24 to develop the electrostatic latent image formed on the photoreceptor 2 with developer and a developer container 25 for containing developer supplied to the development device 24. The development device 24 includes a development roller 26 serving as a developer bearer (or development member), a supply roller 27 serving as a developer supply member to supply developer to the development roller 26, a doctor blade 28 to adjust a layer thickness of developer carried on the development roller 26, and an agitation paddle 29 to agitate developer. The developer container 25 is provided above the development device 24 and contains an agitator 30 to agitate the developer contained therein.

Operation of the development unit 4 is described below.

As the agitator 30 and the agitation paddle 29 rotate, the developer inside the developer container 25 moves down under its own weight toward the supply roller 27 while being agitated. The supply roller 27 includes a metal core and a roller portion constructed of, for example, foam resin, that covers the surface of the metal core. The supply roller 27 rotates while adsorbing developer to an outer surface of the roller portion. The developer adhering to the surface of the supply roller 27 is supplied to the development roller 26 at a position where the supply roller 27 contacts the development roller 26. As the development roller 26 rotates, the developer carried on the surface of the development roller 26 passes through a regulation gap, where a tip of the doctor blade 28 is adjacent to or in contact with the surface of the development roller 26. Thus, the layer thickness of the developer on the development roller 26 is adjusted, forming a thin developer layer thereon. Subsequently, the developer is transported to a development range, where the development roller 26 is adjacent to or in contact with the photoreceptor 2, and adheres to the electrostatic latent image on the photoreceptor 2, thereby developing it into a toner image.

Additionally, as shown in FIG. 2, a developer amount detector 31 is fixed to the optical writing head 6. The developer amount detector 31 employs an optical element to detect the amount of developer inside the developer container 25, and a light guide 32 is provided inside the developer container 25 to guide light emitted from the optical element of the developer amount detector 31.

Configurations of the light guide 32 and the developer amount detector 31 are described in further detail below.

Figure 3:
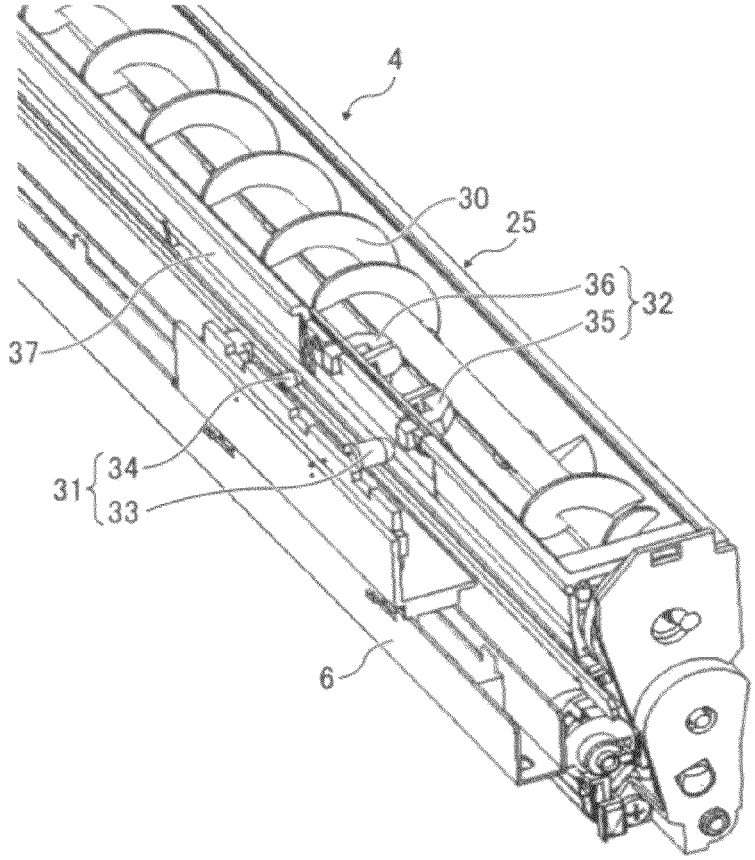
FIG. 3 is a perspective view of a development unit in which a top side of a development housing is removed.

FIG. 3 is a perspective view of the development unit 4 in which a top side of a development housing 37 is removed.

As shown in FIG. 3, the developer amount detector 31 includes a light-emitting element 33 and a light-receiving element 34. The light guide 32 provided inside the developer container 25 includes first and second light guide members 35 and 36. The first and second light guide members 35 and 36 can be constructed of a light transmissive material. When resin is used for the first and second light guide members 35 and 36, acrylic resin and polycarbonate are preferable because they have higher degrees of transparency. Alternatively, tempered glass having better optical properties may be used. Yet alternatively, the first and second light guide members 35 and 36 can be constructed of optical fiber. In this case, design flexibility of the light path can be improved.

Figure 4:
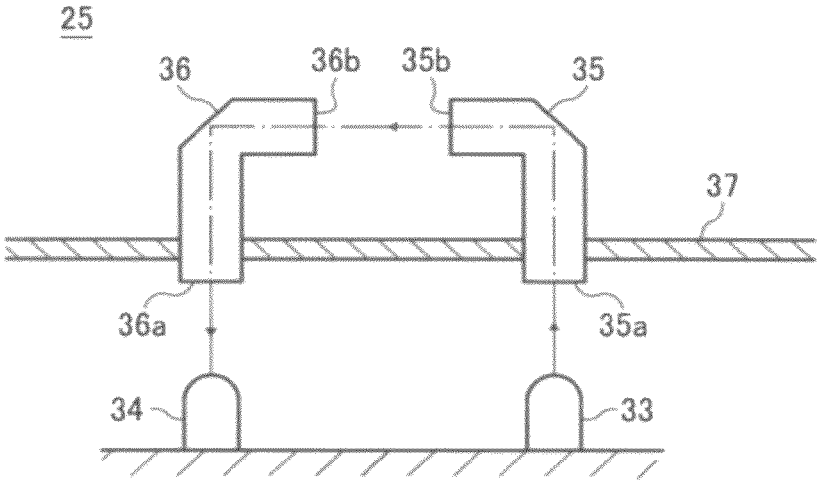
FIG. 4 is a plan view of a light-emitting element, a light-receiving element, and light guide members.

As shown in FIG. 4, a first end portion including a first edge face 35*a* of the first light guide member 35 and a first end portion including a first edge face 36*a* of the second light guide member 36 are exposed outside the development housing 37. The exposed first edge face 35*a* of the first light guide member 35 faces the light-emitting element 33, and the exposed first edge face 36*a* of the second light guide member 36 faces the light-receiving element 34. A second end portion including a second edge face 35*b* of the first light guide member 35 and a second end portion including a second edge face 36*b* of the second light guide member face each other across a given or predetermined clearance inside the development housing 37.

The light emitted from the light-emitting element 33 enters the first light guide member 35 from the exposed first edge face 35*a*, is reflected, and exits from the second edge face 35*b*. The light then enters the second light guide member 36 from the second edge face 36*b* facing the second edge face 35*b* of the first light guide member 35. The light is reflected inside the second light guide member 36, exits from the first edge face 36*a*, and then reaches the light-receiving element 34.

When the amount of developer in the developer container 25 is sufficient, the light is blocked by the developer present in the gap (clearance) between the second edge face 35*b* of the first light guide member 35 and the second edge face 36*b* of the second light guide 36 facing each other. Thus, the light-receiving element 34 does not receive the light. However, as the developer is consumed in printing, the level of the developer in the developer container 25 descends below the first and second light guide members 35 and 36, that is, no developer is present in the gap between the second edge faces 35*b* and 36*b* of the first and second light guide members 35 and 36. Accordingly, the light reaches the light-receiving element 34. The controller can recognize that the level of the developer in the developer container 25 is below the first and second light guide members 35 and 36 with the value output from the light-receiving element 34 at that time.

Figure 5:
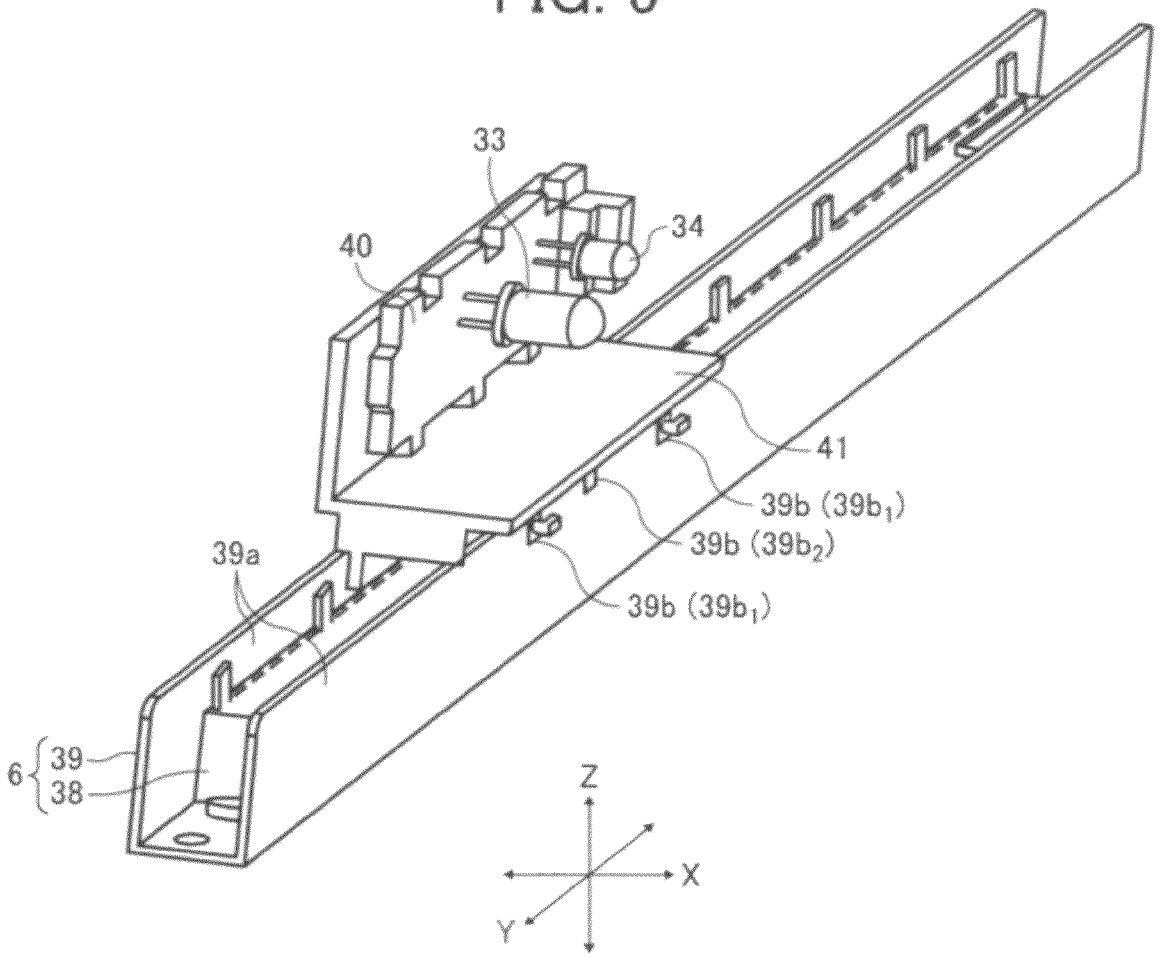
FIG. 5 is a perspective view illustrating an optical writing head to which the light-emitting element and the light-receiving element are attached.

FIG. 5 illustrates the optical writing head 6 as well as the light-emitting element 33 and the light-receiving element 34 attached thereto.

Figure 6:
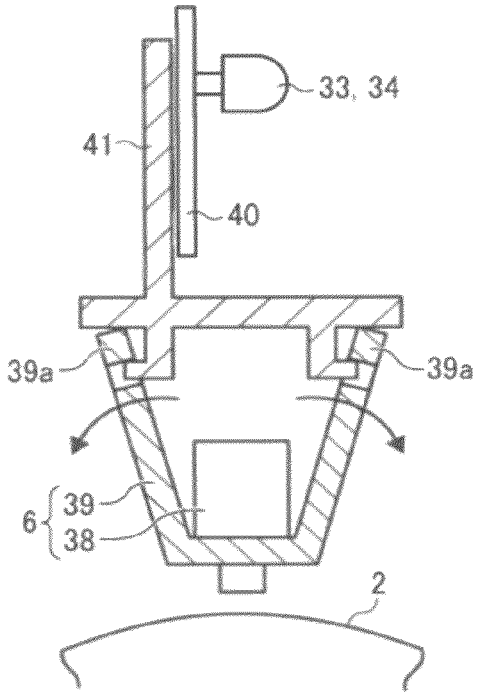
FIG. 6 is a cross-sectional view illustrating a frame of the optical writing head deformed outward.

As shown in FIG. 5, the optical writing head 6 includes a circuit board 38 and a U-shaped frame 39 that surrounds and supports the circuit board 38. In the circuit board 38, multiple optical writing elements and multiple rod lenses are arranged in the longitudinal direction of the photoreceptor 2, which is perpendicular to the surface of the paper on which FIG. 2 or 6 is drawn. Specifically, the frame 39 includes a pair of arms 39*a* each having a free end (upper end in FIG. 5). The free ends of the arms 39*a* are disposed at a distance from each other in the direction in which the photoreceptor 2 rotates, perpendicular to the longitudinal direction of the photoreceptor 2, and the circuit board 38 is disposed between the arms 39*a*. The frame 39 in the present embodiment can be a plate pressed into a U-shape. Alternatively, the frame 39 may be produced through aluminum die casting. Additionally, the light-emitting element 33 and the light-receiving element 34 are attached to a circuit board 40 provided with an electroconductive pattern and the like, and the circuit board 40 is supported by a detector holder 41 attached to the frame 39.

It is to be noted that, in FIG. 5, reference character 39*b* represents cutouts formed in the frame 39 of the optical writing head 6.

FIG. 6 illustrates attachment of the detector holder 41 holding the light-emitting element 33 and the light-receiving element 34 to the frame 39 of the optical writing head 6.

As shown in FIG. 6, the detector holder 41 is attached to the free ends (upper end portion) of the U-shaped frame 39. At that time, if the fee ends of the arms 39*a* are pushed outward by the detector holder 41, and the frame 39 deforms outward as shown in FIG. 6, it is possible that the focal distance of the optical writing head 6 relative to the photoreceptor 2 can deviate, thus disarranging the dots forming the electrostatic latent image on the photoreceptor 2. As a result, image quality is degraded.

Figure 7:
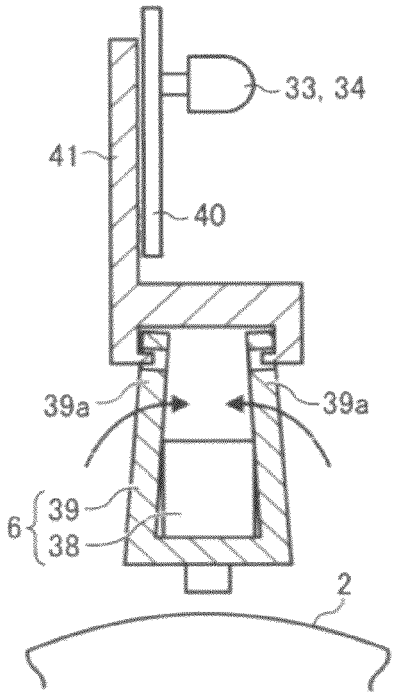
FIG. 7 is a cross-sectional view illustrating the frame of the optical writing head deformed inward.

Further, as shown in FIG. 7, if the fee ends of the arms 39*a* are pushed inward by the detector holder 41, and the frame 39 is deformed inward, the focal distance of the optical writing head 6 relative to the photoreceptor 2 can deviate similarly, degrading image quality.

In view of the foregoing, in the present embodiment, deformation of the frame 39 in attachment of the developer amount detector 31 (light-emitting element 33 and light-receiving element 34) to the optical writing head 6 can be prevented as follows.

FIGS. 8 through 11B illustrate a mounting structure for the developer amount detector 31 according to a first embodiment.

Figure 8:
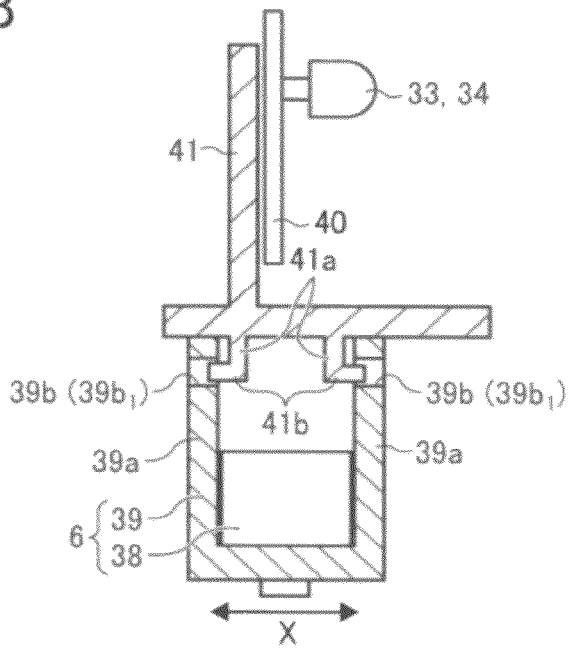
FIG. 8 is a cross-sectional view illustrating a mounting structure for a developer amount detector according to an embodiment.
Figure 9:
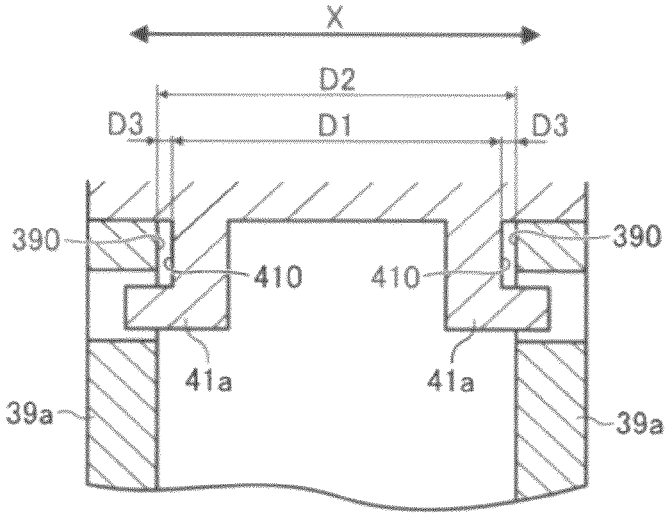
FIG. 9 is an enlarged cross-sectional view illustrating the mounting structure for the developer amount detector.

As shown in FIG. 8, the detector holder 41 includes a pair of legs 41*a* projecting downward from a bottom surface thereof. The legs 41 a are away from each other in the direction in which the photoreceptor 2 rotates, indicated by arrow X (hereinafter "direction X"), identical or similar to the direction in which the arms 39*a* of the frame 39 face each other via the clearance (lateral direction in FIG. 8). In the state shown in FIG. 8, the legs 41*a* fit inside the respective arms 39*a*, and thus the relative movement of the detector holder 41 and the frame 39 in the direction X can be restricted.

Additionally, the legs 41*a* engage the respective arms 39*a* in clearance fit, and a clearance D3 (shown in FIG. 9) is provided therebetween. Specifically, referring to FIG. 9, when "D1" represents a distance between outer faces 410 (hereinafter also "engagement faces 410") of the respective legs 41*a* that engage the respective arms 39*a*, and "D2" represents a distance between inner faces 390 (hereinafter also "engagement faces 390") of the arms 39*a* that engage the respective legs 41*a*, D1<D2.

In the present embodiment, the distance D2 between the inner faces 390 of the respective arms 39*a* is thus made greater than the distance D1 between the outer faces 410 of the respective legs 41*a* to secure the clearance D3 between the engagement faces 390 and 410. Thus, the legs 41*a* can engage the respective arms 39*a* in clearance fit. Accordingly, even when the legs 41*a* are fitted inside the respective arms 39*a*, the distance D2 between the arms 39*a* is not expanded by the legs 41*a*.

It is to be noted that, although both the light-emitting element 33 and the light-receiving element 34 are provided to an identical optical writing head 6 in the description above, alternatively, only one of the light-emitting element 33 and light-receiving element 34 may be provided to the optical writing head 6. Yet alternatively, the light-emitting element 33 and the light-receiving element 34 may be provided to separate optical writing heads 6.

Thus, when the pair of arms 39*a* of the frame 39 engages the detector holder 41 for holding at least one of the light-emitting element 33 and light-receiving element 34 in clearance fit, deformation of the frame 39 can be prevented in attachment of the detector holder 41 to the frame 39.

Additionally, when the clearance D3 between the inner face 390 of the arm 39*a* and the outer face 410 of the leg 41*a* is within a range of from 0.1 mm to 0.5 mm (0.1 mm≤D3≤0.5 mm), easiness in attachment of the detector holder 41 as well as a higher accuracy in the detection of the amount of developer can be attained. More specifically, if the clearance D3 is less than 0.1 mm, the clearance D3 is too small and makes it difficult to attach the detector holder 41 to the frame 39. By contrast, if the clearance D3 is greater than 0.5 mm, it is possible that the backlash between the engagement faces 390 and 410 can exceed a tolerable range for the developer amount detector 31.

Additionally, as shown in FIG. 8, each leg 41*a* of the detector holder 41 includes projections 41*b* (engagement portions) projecting outward in the direction X in an end portion. Corresponding to the projections 41*b*, the cutouts 39*b* (engagement portions) into which the respective projections 41*b* are insertable are formed in each arm 39*a*. In the present embodiment, multiple cutout 39*s* are arranged in the longitudinal direction of the frame 39, and multiple projections 41*b* are provided accordingly.

Figure 10:
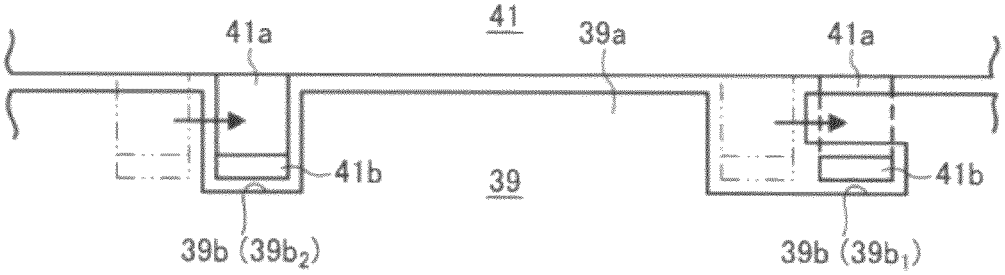
FIG. 10 is a front view illustrating the mounting structure for the developer amount detector.

As shown in FIG. 10, there are two types of cutouts 39*b*: L-shaped first cutouts $\mathbf{39}b_1$ on the right in FIG. 10 and quadrangular second cutouts $\mathbf{39}b_2$ on the left in FIG. 10.

Figure 11A:
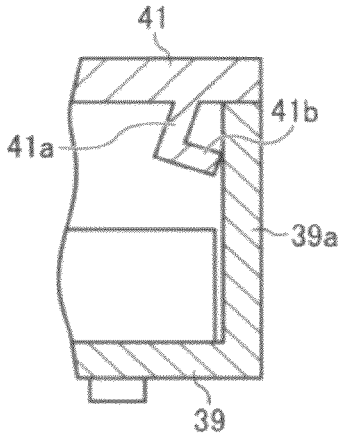
FIGS. 11A and 11B are enlarged cross-sectional views illustrating the mounting structure for the developer amount detector.
Figure 11B:
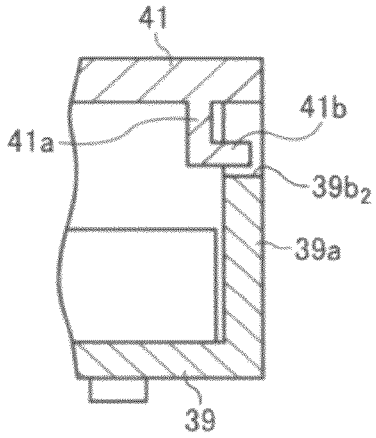

To insert the projections 41*b* into the first cutouts $\mathbf{39}b_1$ and the second cutouts $\mathbf{39}b_2$, initially the projections 41*b* are aligned with upper openings of the first cutouts $\mathbf{39}b_1$. In this state, the detector holder 41 is lowered relative to the frame 39 as indicated by chain double-dashed lines shown in FIG. 10. With this action, the projections 41*b* are inserted inside the first cutouts $\mathbf{39}b_1$. By contrast, the projections 41*b* corresponding to the second cutouts $\mathbf{39}b_2$ are not inserted therein because the projections 41*b* are not aligned with the second cutouts $\mathbf{39}b_2$ in the longitudinal direction of the frame 39. The projections 41*b* corresponding to the second cutouts $\mathbf{39}b_2$ are constructed of an elastic material. As shown in FIG. 11A, the projections 41*b* are in contact with an inner face of the frame 39 in this state, and accordingly the projections 41*b* and the legs 41*a* deform elastically.

Subsequently, the detector holder 41 is moved to the right in FIG. 10, thereby moving the projections 41*b* to a distal side of the first cutouts $\mathbf{39}b_1$. Thus, the engagement between the first cutouts $\mathbf{39}b_1$ and the respective projections 41*b* restricts upward movement of the detector holder 41 relative to the frame 39. Additionally, as the detector holder 41 thus moves, the remaining projections 41*b* are also inserted into the second cutouts $\mathbf{39}b_2$. Specifically, when the elastically deformed legs 41*a* including the projections 41*b* reach the position of the second cutouts $\mathbf{39}b_2$, the projections 41*b* can be inserted into the second cutouts $\mathbf{39}b_2$ due to elastic recovery of the legs 41*a*. Thus, the engagement between the second cutouts $\mathbf{39}b_2$ and the respective projections 41*b* restricts movement of the detector holder 41 relative to the frame 39 in the longitudinal direction of the frame 39.

As described above, with the first and second cutouts $\mathbf{39}b_1$ and $\mathbf{39}b_2$ engaging the respective projections 41*b*, the detector holder 41 can be prevented from moving in the two directions, namely, upward direction and the longitudinal direction, relative to the frame 39. In other words, in FIG. 5, the engagement between the respective projections 41*b* and the respective cutouts $\mathbf{39}b_1$ and $\mathbf{39}b_2$ restricts relative movements between the detector holder 41 and the frame 39 in Y-axis direction as well as Z-axis direction, both perpendicular to the direction X in which the arms 39*a* of the frame 39 are away from each other.

This configuration can prevent unintended disengagement of the detector holder 41 from the frame 39. Additionally, accuracy in positioning the light-emitting element 33 and the light-receiving element 34 can increase because the attachment position of the detector holder 41 relative to the frame 39 can become more reliable. Accordingly, detection accuracy of the developer amount detector 31 can be secured. It is to be noted that, differently from the configuration shown in FIGS. 8 through 11B, the projection 41*b* may be formed on the frame 39, and the cutouts 39*b* may be formed in the detector holder 41.

As described above, although deformation of the frame 39 of the optical writing head 6 can result in deviation of the focal distance of the optical writing head 6 to the photoreceptor 2, the configuration according to the first embodiment can keep the focal distance of the optical writing head 6 constant with a higher degree of accuracy, preventing degradation of image quality.

Additionally, the detector holder 41 includes engagement portions (projections 41*a*) to engage engagement portions (cutouts 39*b*) of the frame 39. The engagement portions of one of the detector holder 41 and the frame 39 are projections, and the engagement portions of the other are cutouts. The engagement between the engagement portions of the detector holder 41 and those of the frame 39 can prevent relative movements between the detector holder 41 and the frame 39 in the Y-axis direction and the Z-axis direction as well as unintended disengagement of the detector holder 41 from the frame 39.

Additionally, at least one of the projections 41*b* is designed to engage the cutout 39*b* due to elastic deformation to facilitate the engagement.

Figure 12:
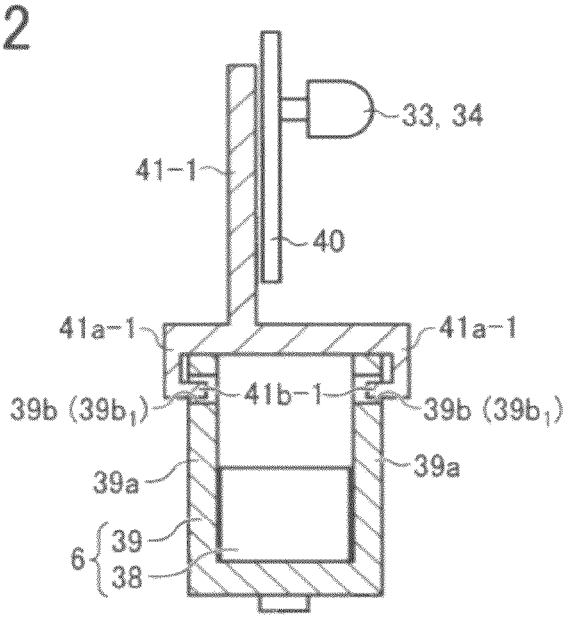
FIG. 12 is a cross-sectional view illustrating a mounting structure for a developer amount detector according to another embodiment.
Figure 13:
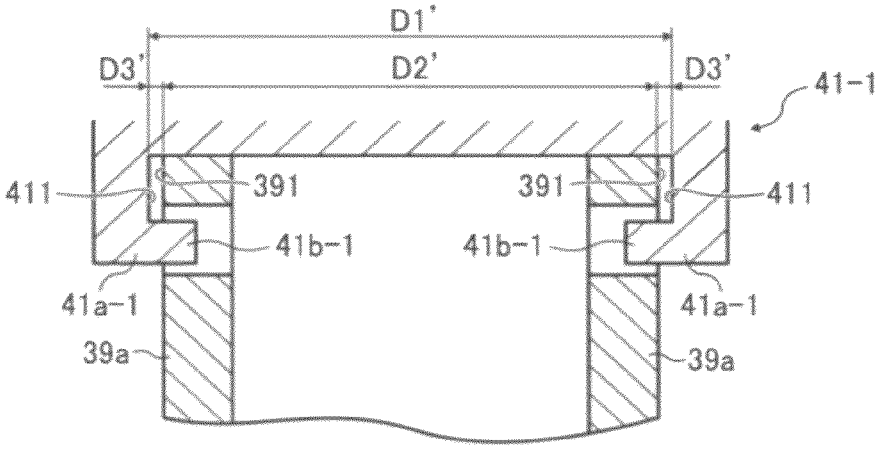
FIG. 13 is an enlarged cross-sectional view illustrating the mounting structure for the developer amount detector shown in FIG. 12.

FIGS. 12 and 13 illustrate a mounting structure for the developer amount detector 31 according to a second embodiment.

It is to be noted that, in the third, fourth, and fifth embodiment, subscripts "−1", "−2", or "−3" are given to reference characters of components having configurations different from those in the first embodiment.

As shown in FIG. 12, a detector holder 41-1 according to the second embodiment is different from that in the first embodiment in that a pair of legs 41*a*-1 of the detector holder 41-1 engages a pair of arms 39*a* from outside. In this configuration, similarly, the arms 39*a* engage the respective legs 41*a*-1 in clearance fit with a clearance D3' (shown in FIG. 13) provided therebetween. Specifically, referring to FIG. 13, a distance D1' between inner faces 411 (engagement faces) of the respective legs 41*a*-1 that engages the respective arms 39*a* is greater than a distance D2' between outer faces 391 (engagement faces") of the arms 39*a* that engage the respective legs 41*a*-1 (D1'>D2'). With this configuration, in the configuration in which the pair of legs 41*a*-1 is fitted outside the pair of arms 39*a*, the frame 39 is not deformed, and the distance between the arms 39*a* is not reduced.

Additionally, when the clearance D3' between the outer face 391 of the arm 39*a* and the inner face 411 of the leg 41*a*-1 is within a range of from 0.1 mm to 0.5 mm (0.1 mm≤D3'≤0.5 mm), easiness in attachment of the detector holder 41-1 as well as a higher accuracy in the detection of the amount of developer can be attained.

Additionally, in the second embodiment, the legs 41*a*-1 include projections 41*b*-1 projecting inward in FIGS. 12 and 13 at end portions thereof, and the arms 39*a* include cutouts 39*b*. There are two types of cutouts 39*b* similarly to the above-described first embodiment: the L-shaped first cutouts $\mathbf{39}b_1$ and quadrangular second cutouts $\mathbf{39}b_2$. The projections 41*b*-1 are inserted into the respective cutouts 39*b*, and the engagement therebetween can prevent relative movements between the detector holder 41-1 and the frame 39 in the Y-axis direction and the Z-axis direction (shown in FIG. 5). The projection 41*b*-1 can be inserted into the respective cutouts 39*b* in a similar manner, and other configurations according to the second embodiment are similar to those of the first embodiment. Thus, descriptions thereof are omitted.

Figure 14:
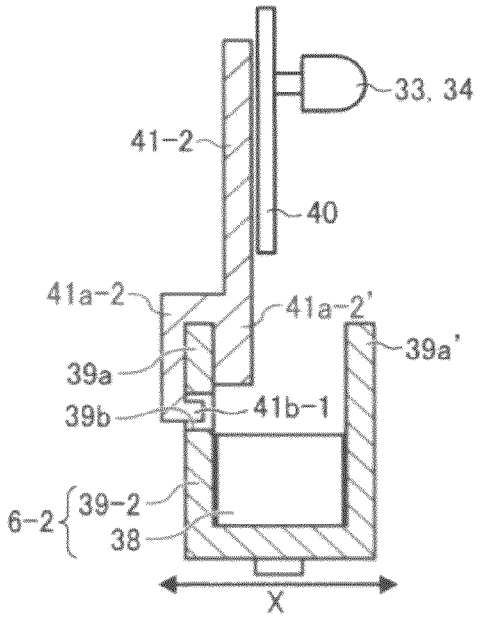
FIG. 14 is a cross-sectional view illustrating a mounting structure for a developer amount detector according to yet another embodiment.

FIG. 14 illustrates a mounting structure for the developer amount detector 31 according to a third embodiment.

In the third embodiment, a detector holder 41-2 includes a pair of legs 41*a*-2 and 41*a*-2' disposed at distance from each other, and a frame 39-2 includes a pair of arms 39*a* and 39*a*'. The arm 39*a* is clamped between the legs 41*a*-2 and 41*a*-2'. In this configuration, because the detector holder 41-2 is fixed to a single arm 39*a* only, the frame 39-2 is neither expanded nor deformed when the detector holder 41-2 is attached thereto.

Clamping the arm 39*a* between the legs 41*a*-2 and 41*a*-2' can prevent relative movement between the detector holder 41-2 and the frame 39-2 in the direction X in which the legs 41*a*-2 and 41*a*-2' are disposed at a distance. Additionally, the engagement between the respective projections 41*b*-1 and the respective cutouts 39*b* restricts relative movements between the detector holder 41-2 and the frame 39-2 in the Y-axis direction and the Z-axis direction, both perpendicular to the direction X. Specifically, similarly to the above-described first and second embodiments, the projections 41*b*-1 are inserted into the two types of cutouts 39*b* (first cutouts $\mathbf{39}b_1$ and second cutouts $\mathbf{39}b_2$), respectively, and the engagement therebetween can prevent relative movements between the detector holder 41-2 and the frame 39-2 in the Y-axis direction and the Z-axis direction.

Figure 15:
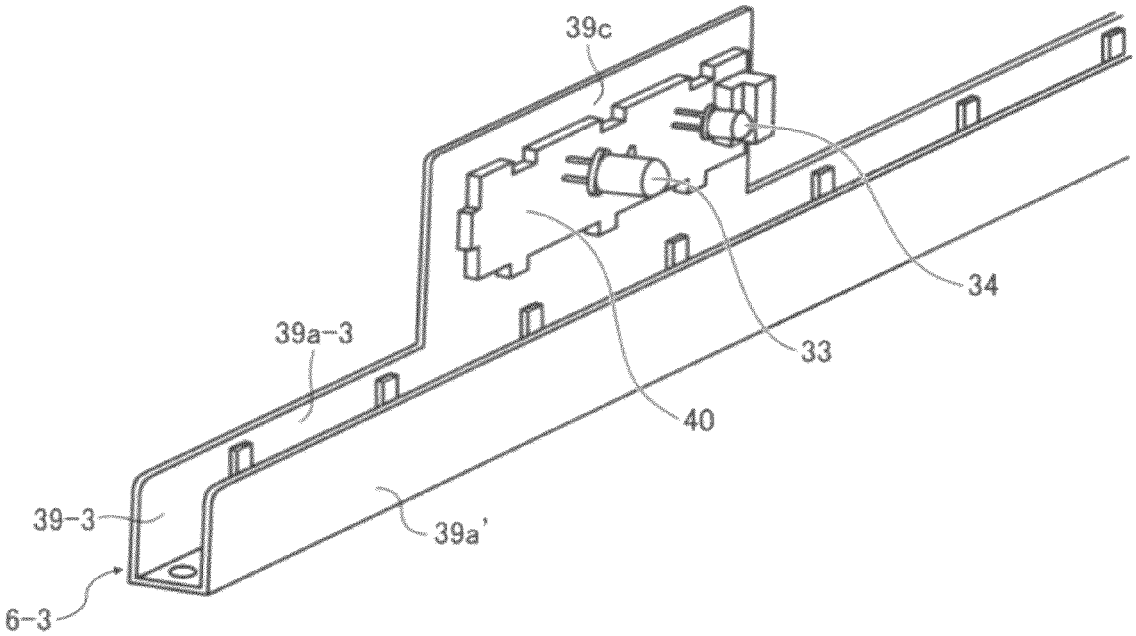
FIG. 15 is a perspective view illustrating a mounting structure for the developer amount detector according to yet another embodiment.
Figure 16:
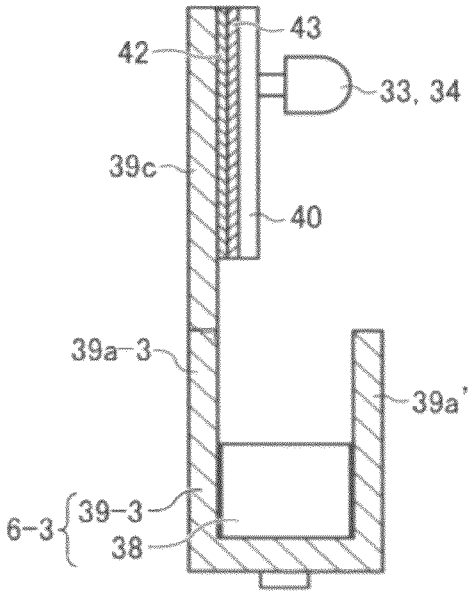
FIG. 16 is a cross-sectional view illustrating the mounting structure for the developer amount detector shown in FIG. 15.

FIGS. 15 and 16 illustrate a mounting structure for the developer amount detector 31 according to the fourth embodiment.

In the fourth embodiment, a frame 39-3 includes a pair of arms 39*a*' and 39*a*-3. The arm 39*a*-3 is extended upward and includes a mounting portion 39*c* to which the circuit board 40 for supporting the light-emitting element 33 and the light-receiving element 34 is fixed. The circuit board 40 may be bonded to the mounting portion 39*c* with an adhesive member 42 such as double-sided adhesive tape as shown in FIG. 16. Alternatively, the circuit board 40 may be glued to the mounting portion 39*c* . Additionally, the frame 39-3 may be constructed of metal, and an electrical insulator 43 may be provided between the circuit board 40 and the frame 39-3 (mounting portion 39*c*) to avoid direct contact therebetween, thereby preventing occurrence of short circuit.

Figure 17:
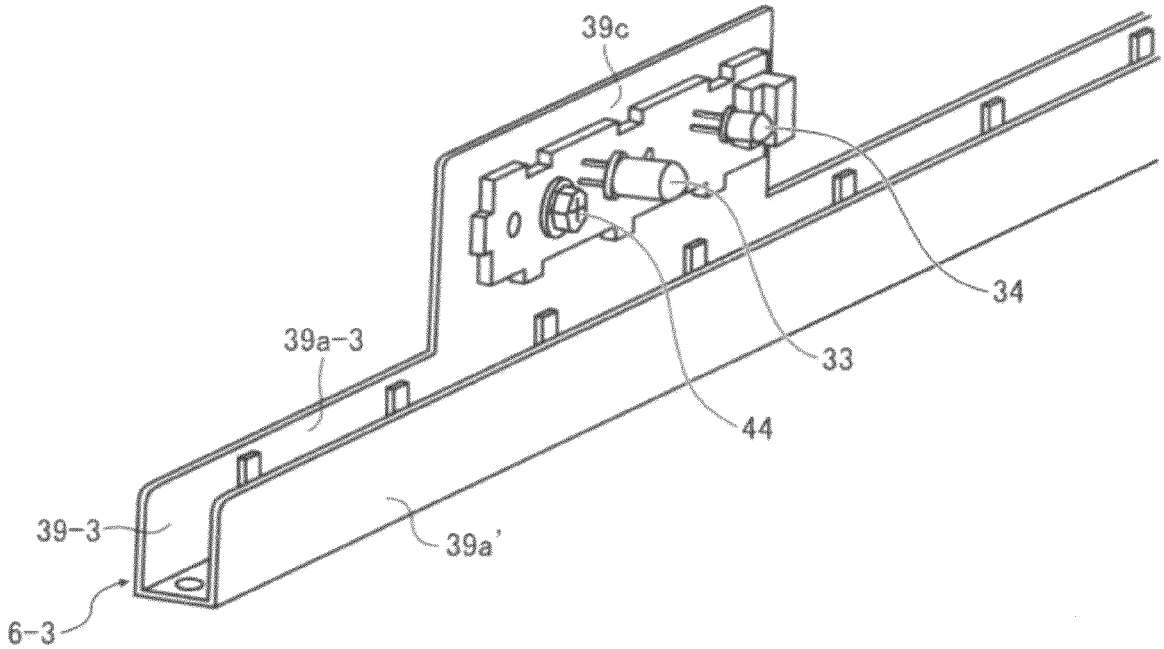
FIG. 17 is a perspective view illustrating a mounting structure for the developer amount detector according to yet another embodiment.
Figure 18:
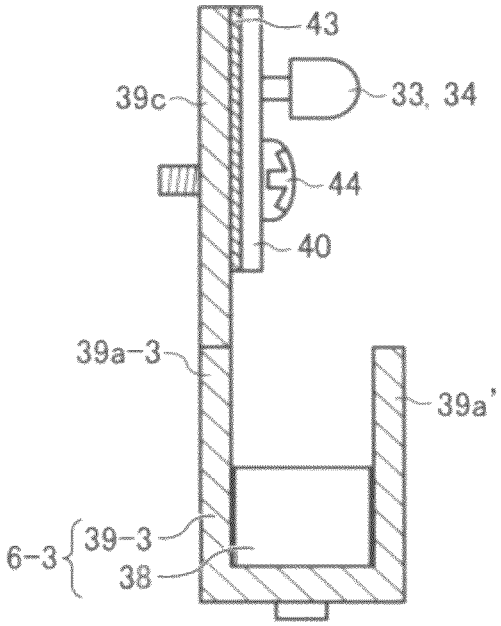
FIG. 18 is a cross-sectional view illustrating the mounting structure for the developer amount detector shown in FIG. 17.

FIGS. 17 and 18 illustrate a variation of the fourth embodiment.

The configurations according to the variation shown in FIGS. 17 and 18 are similar to those of the above-described fourth embodiment except that the circuit board 40 is fixed to the mounting portion 39*c* with a fixture 44 such as a screw.

In the fourth embodiment shown in FIGS. 15 and 16 and the variation shown in FIGS. 17 and 18, the circuit board 40 is fixed only to a single arm 39*a*-3. Accordingly, a force to expand or deform inward the frame 39-3 is not applied to the frame 39-3.

Thus, according to the above-described embodiments, the developer amount detector 31 including the light-emitting element 33 and the light-receiving element 34 is fixed to the optical writing head 6, and the position thereof can be set with a high degree of accuracy. Accordingly, the positioning accuracy and design flexibility of the developer amount detector 31 can be enhanced. Specifically, this configuration can eliminate the necessity of a separate positioning member provided around the developer container 25 for setting in position the developer amount detector 31. Thus, limitations on component layout can be reduced. Additionally, the optical writing head 6 is longer in the direction in which the optical writing elements are aligned, and the developer amount detector 31 can be disposed at any given position in the range where the optical writing elements are arranged. Thus, flexibility in layout of the developer amount detector 31 can be enhanced.

For example, in an arrangement in which the development unit 4 is disposed above the photoreceptor 2 as shown in FIG. 1, there are conventionally few practical options except disposing the developer amount detector 31 on the side wall of the image forming apparatus on the side of the longitudinal end of the development unit 4.

By contrast, according to the above-described features of this specification, at least one of the components of the developer amount detector 31 is provided to the optical writing head 6. That is, the developer amount detector 31 can be disposed at any position in the area where the optical writing head 6 extends. Thus, the developer amount detector 31 can be disposed at a desired position, for example, a position facing the center portion of the developer container 25 in the longitudinal direction, suitable for detecting the amount of developer. Detection accuracy in developer amount detection can be enhanced when at least one of the light-emitting element 33 and the light-receiving element 34 are disposed in the center portion of the developer container 25 in the longitudinal direction, in which the amount of developer is relatively uniform. Accordingly, the detection accuracy can be enhanced.

Additionally, the above-described features of this specification can eliminate the need for longer light guide to detect the amount of developer at a desired position, thus attaining a higher accuracy in developer amount detection at a relatively low cost.

Further, the mounting structure according to the above-described embodiments can prevent deformation of the frame 39 of the optical writing head 6 in attachment of the developer amount detector 31 to the optical writing head 6. Accordingly, the focal distance of the optical writing head 6 relative to the photoreceptor 2 can be kept constant at a higher degree of accuracy, and thus degradation in image quality can be prevented or alleviated.

Additionally, the features of the above-described embodiments can adapt to other image forming apparatuses than tandem-type electrophotographic image forming apparatuses in which four process units are arranged laterally. For example, the features of the above-described embodiments can be adapted for single-color image forming apparatuses, or image forming apparatuses capable of image formation of five or more different colors. The image forming apparatus may be a copier, a printer, a facsimile machine, or a multi-function machine having at least two of those capabilities. Moreover, the process units 1 may be arranged vertically, and layout of other components such as the intermediate transfer belt 8 and the fixing device 18 can be changed.

It is not necessary to unit all of image forming components, such as the developer container 25, the development device 24, and the photoreceptor 2, into a single modular unit as the process unit 1. Alternatively, only the developer container 25 and the development device 24 may be united into a single unit removably installable in the apparatus, or the developer container 25 may be independently installed or removed from the apparatus.

Although the description above concerns configurations using two-component developer consisting essentially of carrier and toner, the above-described features of this specification can adapt to image forming apparatuses using one-component developer.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image bearer;

an optical writing unit that writes an electrostatic latent image on the image bearer, the optical writing unit including multiple optical writing elements arranged in a longitudinal direction of the image bearer and a frame to hold the multiple optical writing elements;

a development device to develop the electrostatic latent image on the image bearer with developer;

a developer container for containing the developer supplied to the development device; and a developer amount detector to detect an amount of developer contained in the developer container based on a light transmission amount, the developer amount detector including a light-emitting element and a light-receiving element, wherein the frame of the optical writing unit includes at least one arm, and wherein at least one of the light-emitting element and the light-receiving element of the developer amount detector is attached to the at least one arm of the frame of the optical writing unit.

2. The image forming apparatus according to claim 1, further comprising a detector holder to hold the at least one of the light-emitting element and the light-receiving element attached to the optical writing unit, wherein the at least one arm of the frame of the optical writing unit is one of a pair of arms facing across a first distance in a direction X between the pair of arms, wherein the multiple optical writing elements are interposed between the pair of arms, wherein the direction X is perpendicular to the longitudinal direction of the image bearer, and wherein the pair of arms engage the detector holder in clearance fit and restrict relative movement between the detector holder and the frame of the optical writing unit in the direction X.

3. The image forming apparatus according to claim 2, wherein the detector holder comprises a pair of legs separated by a second distance in the direction X, wherein each of the pair of legs is fitted inside an inner face of a respective arm of the pair of arms of the frame, and wherein a distance between outer faces of the pair of legs is smaller than a distance between the inner faces of the pair of arms of the frame.

4. The image forming apparatus according to claim 2, wherein the detector holder comprises a pair of legs separated by a second distance in the direction X, wherein each of the pair of legs is fitted outside an outer face of a respective arm of the pair of arms of the frame, and wherein a distance between inner faces of the pair legs is greater than a distance between the outer faces of the pair of arms of the frame.

5. The image forming apparatus according to claim 2, wherein the detector holder and the frame comprise respective engagement portions that engage to restrict relative movements between the detector holder and the frame in directions Y and Z, wherein each of the directions Y and Z is perpendicular to the direction X, wherein an engagement portion of one of the detector holder and the frame includes a projection, and an engagement portion of the other of the detector holder and the frame includes a cutout into which the projection is inserted.

6. The image forming apparatus according to claim 5, wherein one of the detector holder and the frame is an elastic member to which the projection is provided, and wherein the projection engages the cutout due to elastic deformation of the elastic member.

7. The image forming apparatus according to claim 1, further comprising a detector holder to hold the at least one of the light-emitting element and the light-receiving element, wherein the detector holder is attached to the at least one arm of the frame.

8. The image forming apparatus according to claim 7, wherein the detector holder comprises a pair of legs disposed at a distance from each other in a direction X that is perpendicular to the longitudinal direction of the image bearer, and the at least one arm of the frame of the optical writing unit is positioned between the pair of legs of the detector holder to restrict the relative movement between the detector holder and the frame in the direction X.

9. The image forming apparatus according to claim 8, wherein the detector holder and the frame comprise respective engagement portions to engage each other to restrict relative movements between the detector holder and the frame in directions Y and Z, wherein each of the directions Y and Z is perpendicular to the direction X, and wherein an engagement portion of one of the detector holder and the frame includes a projection, and an engagement portion of the other the detector holder and the frame includes a cutout into which the projection is inserted.

10. The image forming apparatus according to claim 9, wherein one of the detector holder and the frame is an elastic member to which the projection is provided, and wherein the projection engages the cutout due to elastic deformation of the elastic member.

11. The image forming apparatus according to claim 1, further comprising a circuit board to support the at least one of the light-emitting element and the light-receiving element, wherein the circuit board is attached to the at least one arm of the frame.

12. The image forming apparatus according to claim 11, wherein the frame including the at least one arm is constructed of metal, and an electrical insulator is provided between the at least one arm of the frame and the circuit board.

13. The image forming apparatus according to claim 1, wherein the developer container is positioned above the image bearer.

14. The image forming apparatus according to claim 1, wherein the light-emitting element and the light-receiving element of the developer amount detector are disposed facing a center portion of the developer container in a longitudinal direction of the developer container.

15. The image forming apparatus according to claim 1, wherein the light-emitting element and the light-receiving element of the developer amount detector are separated by a distance in a direction Z that is parallel to the longitudinal direction of the image bearer.

16. An image forming apparatus comprising:

an image bearer;

an optical writing unit that writes an electrostatic latent image on the image bearer, the optical writing unit including multiple optical writing elements arranged in a longitudinal direction of the image bearer and a frame to hold the multiple optical writing elements;

a development device to develop the electrostatic latent image on the image bearer with developer;

a developer container for containing the developer supplied to the development device; and a developer amount detector to detect an amount of developer contained in the developer container based on a light transmission amount, the developer amount detector including a light-emitting element and a light-receiving element, wherein at least one of the light-emitting element and the light-receiving element of the developer amount detector is attached to the optical writing unit, and wherein the developer container is positioned above the image bearer.

17. An image forming apparatus comprising:

an image bearer;

an optical writing unit that writes an electrostatic latent image on the image bearer, the optical writing unit including multiple optical writing elements arranged in a longitudinal direction of the image bearer and a frame to hold the multiple optical writing elements;

a development device to develop the electrostatic latent image on the image bearer with developer;

a developer container for containing the developer supplied to the development device; and a developer amount detector to detect an amount of developer contained in the developer container based on a light transmission amount, the developer amount detector including a light-emitting element and a light-receiving element, wherein at least one of the light-emitting element and the light-receiving element of the developer amount detector is attached to the optical writing unit, and wherein the light-emitting element and the light-receiving element of the developer amount detector are disposed facing a center portion of the developer container in a longitudinal direction of the developer container.

* * * * *